US007412381B1

(12) United States Patent
Lee

(10) Patent No.: US 7,412,381 B1
(45) Date of Patent: Aug. 12, 2008

(54) METHOD AND APPARATUS FOR DIVERSITY CONTROL IN MULTIPLE DESCRIPTION VOICE COMMUNICATION

(75) Inventor: Cheng-Chieh Lee, Irvine, CA (US)

(73) Assignee: Lucent Technologies Inc., Murray Hill, NJ (US)

( * ) Notice: Subject to any disclaimer, the term of this patent is extended or adjusted under 35 U.S.C. 154(b) by 1872 days.

(21) Appl. No.: 09/672,511

(22) Filed: Sep. 28, 2000

Related U.S. Application Data

(60) Provisional application No. 60/232,260, filed on Sep. 14, 2000.

(51) Int. Cl.
*G10L 19/12* (2006.01)

(52) U.S. Cl. ..... 704/222; 704/223

(58) Field of Classification Search ..... 704/222–223, 704/226, 230
See application file for complete search history.

(56) References Cited

U.S. PATENT DOCUMENTS

| | | | | |
|---|---|---|---|---|
| 4,437,087 | A | 3/1984 | Petr | 340/347 |
| 5,233,660 | A | 8/1993 | Chen | 381/38 |
| 6,665,646 | B1 * | 12/2003 | John et al. | 704/500 |
| 6,823,018 | B1 * | 11/2004 | Jafarkhani et al. | 375/245 |

OTHER PUBLICATIONS

Goodman, D. et al., "Waveform Substitution Techniques for Recovering missing Speech Segments in Packet Voice Communications," *IEEE Trans. ASSP*, pp. 1440-1448, (1986).
Gamal, A. et al., "Achievable Rates for Multiple Descriptions," *IEEE Trans. IT*, pp. 851-857 (1982).
Servetto, S.D. et al., "Multiple Description Lattice Vector Quantization", *Proceedings of IEEE Data Compression Conference*, (1999).
ITU-T Recommendation Summary No. G. 726.
ITU-T Recommendation Summary No. G. 711.
ITU-T Recommendation Summary No. G. 728.
ITU-T Recommendation Summary No. P. 861.

* cited by examiner

*Primary Examiner*—Angela Armstrong
(74) *Attorney, Agent, or Firm*—Kenneth M. Brown

(57) ABSTRACT

A method and apparatus for performing multiple descriptive source coding in which a plurality of homogeneous encoders are advantageously employed in combination with a corresponding plurality of advantageously substantially identical decoders. In particular, diversity is provided to the multiple encoders by modifying the quantization process in at least one of the encoders such that the modified quantization process is based at least on a quantization error resulting from the quantization process of another one of the encoders. In this manner, diversity among the multiple bit streams is obtained, and in particular, the quality of a reconstructed signal based on a combination of multiple decoded bit streams at the receiver is advantageously superior to that based on any one of the decoded bit streams. In accordance with a first illustrative embodiment of the present invention, two Pulse Code Modulation (PCM) coders are employed. In accordance with a second illustrative embodiment of the present invention, two Adaptive Differential Pulse Code Modulation (ADPCM) coders are employed. And in accordance with a third illustrative embodiment of the present invention, two Low-Delay Code Excited Linear Prediction (LD-CELP) coders are employed. In each case, diversity is ensured by an appropriate modification to the quantization process of at least one of the encoders, and the total error may be advantageously reduced when decoded bit streams from both coders are combined at the receiver.

20 Claims, 1 Drawing Sheet

METHOD AND APPARATUS FOR DIVERSITY CONTROL IN MULTIPLE DESCRIPTION VOICE COMMUNICATION

CROSS-REFERENCE TO RELATED APPLICATION

The present application hereby claims the benefit of previously filed Provisional patent application Ser. No. 60/232,260, "Method and Apparatus for Diversity Control in Multiple Description Voice Communication," filed by C-C. Lee on Sep. 14, 2000.

FIELD OF THE INVENTION

The present invention relates generally to the field of multiple description (i.e., multi-descriptive) source coding for signals such as speech signals, and more particularly to a method and apparatus for providing diversity in such a multi-descriptive encoding when homogeneous coders are employed.

BACKGROUND OF THE INVENTION

Providing high-quality telephony services over packet networks has introduced many new technical challenges. One such challenge is to conceal channel erasures, which may occur due to packet loss. Normally, packet loss which is due to the late arrival of a given packet can be alleviated by using buffering techniques at the receiving terminal, at the expense of an increased end-to-end delay. Packet loss due to other causes can be mitigated by replacing missing segments with waveform segments based on correctly received packets. A number of such waveform substitution techniques (i.e., concealment techniques) have been proposed and will be familiar to those of ordinary skill in the art. Most of these techniques appear to be effective for short channel erasures (e.g., those less than about 20 milliseconds), but their performance drops quickly as the rate of channel erasure increases.

To improve a system's resilience to channel erasures, one well known approach is to employ multiple "uncorrelated" channels to deliver the same bit stream. Effectively, then, the channel is "erased" only when all channels fail on the same packet of information. Since all of these multiple channels are uncorrelated, the rate of channel erasure can be greatly reduced. This will in turn help to sustain the performance level of the aforementioned concealment techniques.

Such an improved communication system exploits the diversity from multiple uncorrelated channels to reduce the rate of channel erasure. However, there is no diversity in the encoded bit streams—the information received from more than one working channel will have no added value. A more advantageous result is achieved by sending different information over each channel in such a way that if the corresponding information from multiple channels are successfully transmitted, the information from each channel can be used to augment the information from other channels to thereby improve the overall fidelity of the reconstructed signal. On the other hand, if less than all of the channels are successfully transmitted, the information received will still be sufficient to achieve a reduced, but at least minimally acceptable fidelity. This approach, familiar to those skilled in the art, is known as multiple description (or multi-descriptive) source coding.

Recently, there have been extensive efforts dedicated to the design of efficient multiple descriptive coding systems. In particular, such systems typically allocate a separate codec (coder/decoder pair) for each channel, wherein each codec comprises a different encoder and a corresponding decoder. On the transmission side of the channels, the multiple encoders advantageously produce diversified information. At the receiving end, should one channel fail, the associated decoder temporarily stops its operation, and if necessary, may use conventional concealment mode techniques, fully familiar to those skilled in the art, to maintain any necessary internal memory states. Otherwise, each decoder operates normally. Output signals from all operating decoders are then mixed to produce the final decoded signal. (In the case where all channels have failed, a conventional concealment mode technique may be used to synthesize the output signal.)

Although the above-described scheme works well, the encoders and (more importantly) the decoders which are used must necessarily have been specifically designed for the given multiple description coding technique. Thus, existing network environments which employ encoders and decoders which have not been designed with multiple description coding applications in mind cannot take advantage of the benefits of such a technique. It would be extremely advantageous if the benefits of multiple description coding techniques could be realized in existing network environments, particularly without the need to modify the existing decoders, and preferably, with only slight modifications being required in the existing encoders.

SUMMARY OF THE INVENTION

In accordance with the principles of the present invention, a multiple descriptive source coding technique is provided in which a plurality of homogeneous encoders are advantageously employed in combination with a corresponding plurality of advantageously substantially identical decoders. In particular, diversity is provided to the multiple encoders by modifying the quantization process in at least one of the encoders such that the modified quantization process is based at least on a quantization error resulting from the quantization process of another one of the encoders. In this manner, diversity among the multiple bit streams is obtained, and in particular, the quality of a reconstructed signal based on a combination of multiple decoded bit streams at the receiver is advantageously superior to that based on any one of the decoded bit streams alone.

In accordance with certain illustrative embodiments of the present invention, two Pulse Code Modulation (PCM) coders are employed. In one such case, one of the PCM coders (referred to herein as the "auxiliary" coder) quantizes a given sample point based at least in part on the quantization of that sample point by the other PCM coder (referred to herein as the "primary" coder), in particular so as to use an adjacent quantization value to that which was used by the primary coder whenever the sample point is closer to the midpoint between the two adjacent values than to the value used by the primary coder. In this manner, the total error is advantageously reduced when decoded bit streams from both coders are combined at the receiver.

In accordance with other illustrative embodiments of the present invention, two Adaptive Differential Pulse Code Modulation (ADPCM) coders are employed. In one such case, one of the ADPCM coders (referred to herein as the "auxiliary" coder) quantizes a given sample point based at least in part on the quantization of that sample point by the other ADPCM coder (referred to herein as the "primary" coder) so as to ensure that the quantization noise introduced by the two coders are of opposite sign. In this way, the total error is advantageously reduced when decoded bit streams from both coders are combined at the receiver.

In accordance with yet other illustrative embodiments of the present invention, two Low-Delay Code Excited Linear Prediction (LD-CELP) coders are employed. In one such case, one of the LD-CELP coders (referred to herein as the "auxiliary" coder) quantizes a given sample point with use of an excitation vector based at least in part on the quantization of that sample point by the other LD-CELP coder (referred to herein as the "primary" coder) so as to ensure that the excitation vectors used to quantize the sample point are different. In this way, diversity is ensured, and the total error may be advantageously reduced when decoded bit streams from both coders are combined at the receiver.

DETAILED DESCRIPTION

Overview of the Illustrative Embodiments

Figure 1:
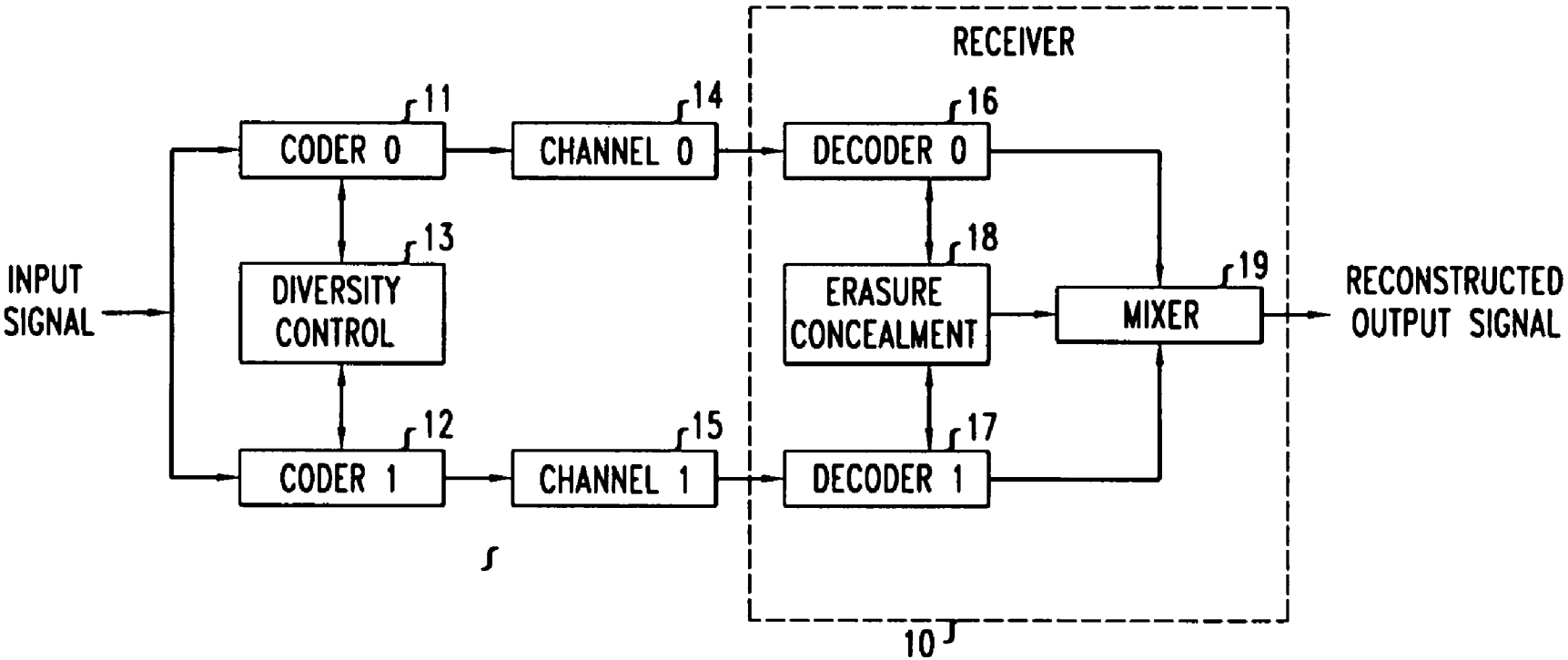
FIG. 1 shows an illustrative two-channel multiple description communications system in accordance with the principles of the present invention.

FIG. 1 shows an illustrative two-channel multiple description communications system in accordance with the principles of the present invention. The system of FIG. 1 includes coders 11 and 12, diversity control module 13, channels 14 and 15, and receiver 10 which comprises decoders 16 and 17, erasure concealment module 18, and mixer 19.

In operation, the illustrative system of FIG. 1 provides two multiple description bit streams generated from the single input source (e.g., speech) signal by coder 11 and coder 12, respectively, which bit streams may be transmitted through channel 14 and channel 15, respectively, and may then be decoded by decoder 16 and decoder 17, respectively, to produce two independent decoded bit streams. The two decoded bit streams are then combined by mixer 19 to produce the reconstructed output (e.g., speech) signal. In the event that one of the two bit streams is not available due to frame erasure (i.e., packet loss), the corresponding decoder is stopped (so as not to produce an output for mixer 19) and solely the other decoder is used to generate the reconstructed output signal. If both of the two bit streams are unavailable, conventional concealment techniques, familiar to those skilled in the art may be employed to generate the reconstructed output signal. In addition, conventional concealment techniques may be employed to update the internal state variables (if necessary) of any decoder which has been stopped as a result of frame erasure.

Coders 11 and 12 are advantageously homogeneous—that is, they are of the same type and use essentially identical coding algorithms, which algorithms may be conventional and will therefore be fully familiar to those of ordinary skill in the art. However, the quantization processes (and, advantageously, no more) of one or both of these coders has been modified in accordance with the principles of the present invention so that at least one of these coders (at least a portion of the time) quantizes each given sample point to be encoded based in part on the quantization error introduced by the other coder on the corresponding sample point. Note that in some illustrative embodiments of the present invention the sample points being quantized may be representative of individual time point samples of the source (e.g., speech) signal being coded, while in other illustrative embodiments the sample points may be individual frequency point samples of a frequency transform which has been performed on a given segment of the source signal being coded. In other illustrative embodiments, the sample points may be other data which is related to the source signal and is to be encoded by the system.

More particularly, in certain illustrative embodiments of the present invention, coder 12, for example, advantageously comprises an identical coding algorithm to the coding algorithm comprised in coder 11, except that the quantization process of coder 12 has been modified so as to base the quantization value which it selects in part on the quantization value selected by, and/or the quantization error which results from, the quantization process of coder 11. Specifically, by using the knowledge of which quantization value has been selected by coder 11, the quantization process of coder 12 may, in certain situations, advantageously select a quantization value other than the value that it would otherwise select, if by doing so, an improved reconstructed signal may be achievable by the receiver when both channels are successfully transmitted and received.

In the case described immediately above, we refer to coder 11 as the "primary" coder (i.e., the coder whose quantization process is not being based on the quantization value selected by and/or the resultant quantization error from the other coder), and we refer to coder 12 as the "auxiliary" coder (i.e., the coder whose quantization process is based on the quantization value selected by and/or the resultant quantization error from the other coder). In various illustrative embodiments of the present invention, the specific method used by the quantization process of the auxiliary coder (i.e., the specific manner in which the quantization process is modified from that of the primary coder) may vary, according to, inter alia, the coding algorithm employed by the coders. (See, e.g., the discussion of the various illustrative embodiments described below.)

At the receiver, erasure concealment module 18 provides control for decoders 16 and 17 and mixer 19 when one or both channels experience a frame erasure (i.e., packet loss) Should one channel fail, erasure concealment module 18 temporarily stops the operation of the associated decoder, and, if necessary, causes the stopped decoder to maintain and/or appropriately update its internal memory state. It then controls mixer 19 to use only the decoder associated with the channel that has not failed. In the case where both channels have failed, conventional concealment mode techniques, fully familiar to those of ordinary skill in the art, may be used to synthesize the output signal, either from just one of the (otherwise stopped) decoders, or from a combination of both decoders.

Note that, since each decoder stops its operation during channel failures, the decoder state (if present) will likely diverge from the corresponding encoder state. Therefore, at the end of every channel failure, the decoder state is advantageously corrected so that the decoder can seamlessly resume its operation. In accordance with certain illustrative embodiments of the present invention, the internal state from an operating decoder (which, in accordance with the principles of the present invention, is advantageously homogenous with respect to the stopped decoder—i.e., they operate with identical decoding algorithms), may be advantageously loaded into the decoder which has been stopped. In accordance with other illustrative embodiments of the present invention, an encoding capability may be added to the receiver, in which case the stopped decoder can update its state by merely re-encoding the reconstructed output signal as produced by mixer 19.

And finally, in accordance with the principles of the present invention, diversity control module 13 may provide the necessary control to enable at least one of the coders to base its associated quantization process on the quantization value selected by and/or the quantization error that results from the quantization process of the other coder. In some illustrative embodiments of the present invention, diversity control module 13 merely provides either the information regarding the quantization value selected by the quantization process of the primary coder (e.g., coder 11), or the quantization error resulting therefrom, to the quantization process of the auxiliary coder (e.g., coder 12). In other illustrative embodiments, however, diversity control module 13 may be absent altogether. In such cases, the auxiliary coder (e.g., coder 12) does not need any special "connection" to the primary coder (e.g., coder 11) in order to "know" the selected quantization value and/or the resultant quantization error of the primary coder, as it is capable of determining such information based on its own internal analysis.

And, in addition, in certain illustrative embodiments of the present invention, diversity control module 13 allows coders 11 and 12 to switch their primary and auxiliary "roles," possibly by providing the information regarding the quantization value selected by and/or the quantization error which results from the quantization process of each of the coders to the quantization process of the other coder, and, in any event, by instructing the two coders as to which one is to serve as the primary coder (i.e., the coder whose quantization process is not based on the quantization value selected by or the resultant quantization error from the other coder) and which one is to serve as the auxiliary coder (i.e., the coder whose quantization process is based on the quantization value selected by and/or the resultant quantization error from the other coder), at a given point in time. For example, diversity control module 13 may switch the "roles" of the two coders in a regular, periodic fashion. (See the discussion below.)

Note that for the sake of simplicity, all of the illustrative embodiments which are specifically shown and described herein provide for two multiple description bit streams and two corresponding codecs (encoder/decoder pairs). However, in accordance with the principles of the present invention, extensions of each of these illustrative embodiments to corresponding embodiments with three or more multiple description bit streams will in each case be obvious to those skilled in the art. For example, in three bit stream embodiments of the present invention in which three homogeneous coders are employed, the quantization process of a second one of the encoders might be based on the quantization performed by a first one of the encoders, while the quantization process of a third one of the encoders might be based on the quantization performed by the second one of the encoders. In such a case, the first one of the encoders serves as the "primary" encoder, while the second and third encoders serve as a "first auxiliary" encoder and a "second auxiliary" encoder, respectively. Moreover, the "roles" of these three coders may, in certain illustrative three bit stream embodiments, be cycled in, for example, a periodic fashion. Many other arrangements in accordance with the principles of the present invention which may be employed in multiple description source coding systems providing three or more independent bit streams will also be easily derivable by those skilled in the art.

Illustrative Embodiments of the Present Invention Employing PCM Coders

In accordance with certain illustrative embodiments of the present invention, a multiple description encoding procedure is provided in which homogeneous coders employing Pulse Code Modulation (PCM) coding techniques are employed. (Note that PCM coding techniques are conventional and are fully familiar to those of ordinary skill in the art. Specifically, it is well known that PCM coding techniques code an input signal by encoding each source sample point with use of a reproduction alphabet containing discreet quantization values, and in particular, by selecting the quantization value which is closest to the given source sample point being encoded.)

In accordance with one such illustrative embodiment of the present invention, the two PCM coders both use a common reproduction alphabet $Q=\{q_i\}$. Thus, by mixing the decoded signals at the receiver, the overall reproduction alphabet effectively contains all $q_i \epsilon Q$, as well as all those mid-points $p_i=(q_i+q_{i+1})/2$ of two neighboring points $q_i$ and $q_{i+1}$ in Q, since mixing (averaging) two values from the set $\{q_i\}$ produces either one of the values $q_i$ or one of the values $p_i$. If a source sample x happens to be closer to a mid-point value $p_i$ than to any $q_i \epsilon Q$, it would clearly be advantageous if one of the coders (e.g., the primary coder) were to quantize x to the closest point $q_i \epsilon Q$ while the other coder (e.g., the auxiliary coder) were to quantize x to $q_{i+1}$ (or to $q_{i+1}$). In this manner, the mixer of the receiver will advantageously produce the "optimal" possible reconstructed value, namely $p_i$ (assuming, of course, that both decoded bit streams are available), whenever $p_i$ is closer to the source sample x than is the closest $q_i$. As will be obvious to those of ordinary skill in the art, the net result of this approach is a coding system which provides twice the resolution (i.e., half the quantization error) in the absence of frame erasures or packet loss.

Specifically, then, in accordance with one illustrative embodiment of the present invention employing PCM coders, the primary coder quantizes the source sample x to the closest quantization value $q_i$ in its reproduction alphabet, as is conventional for a PCM coder. Meanwhile, however, the quantization process of the auxiliary coder has been modified as follows. First, the auxiliary coder quantization process determines the quantization error which results from the primary coder's quantization process (i.e., the difference between the source sample point x and the closest quantization value in the reproduction alphabet, $q_i$). If that quantization error is greater than one quarter (¼) of the difference between $q_i$ and its nearest neighbor, $q_{i+1}$ (or, alternately, $q_{i+1}$, depending on the sign of the quantization error), then sample point x is necessarily closer to the mid-point of $q_i$ and $q_{i+1}$ (or $q_{i+1}$) than it is to $q_i$ itself. Therefore, the quantization process of the auxiliary coder advantageously selects quantization value $q_{i+1}$ (or $q_{i+1}$) rather than selecting $q_i$, as would the quantization process of an unmodified PCM coder.

In accordance with one alternative embodiment of the present invention using PCM coders, the primary and auxiliary coders use different reproduction alphabets. For example, the primary coder uses the reproduction alphabet $Q=\{q_i\}$ as above, while the auxiliary coder uses a reproduction alphabet which consists of the mid-points $P=\{p_i\}$ of the alphabet Q as described above. Then, each coder simply quantizes the source sample point x to the closest quantization value in its respective reproduction alphabet. In this manner, the two coders complement each other, and the reconstructed signal at the receiver will again advantageously provide twice the resolution (half the quantization error) in the absence of frame erasures or packet loss. (Note that the multiple descriptive coding system in accordance with this particular illustrative embodiment has decoders which differ from one another in that the reproduction alphabets used by the decoders necessarily correspond to those of the associated encoders.)

And in accordance with another alternative embodiment of the present invention using PCM coders, the two coders are identical in all respects including their respective quantization processes, but the input signal is advantageously modified prior to being supplied to one of them. For example, both the primary coder and the auxiliary coder may use the common reproduction alphabet $Q=\{q_i\}$ as above, and both coders may quantize their respective input source sample to the closest quantization value in the reproduction alphabet in all cases. However, the input signal to the auxiliary coder is advantageously offset by a predetermined amount, which, for example, may be set equal to one half of the difference between successive quantization values ($q_i$ and $q_{i+1}$). Such an approach again results in a reconstructed signal at the receiver which provides twice the resolution (half the quantization error) in the absence of frame erasures or packet loss. In this illustrative embodiment, however, completely identical and unmodified encoders (as well as decoders) are advantageously employed, while still achieving the benefits of the present invention.

Illustrative Embodiments of the Present Invention Employing ADPCM Coders

In accordance with other illustrative embodiments of the present invention, a multiple description encoding procedure is provided in which homogeneous coders employing Adaptive Differential Pulse Code Modulation (ADPCM) coding techniques are employed. (Note that ADPCM coding techniques are also conventional and are fully familiar to those of ordinary skill in the art. See, e.g., U.S. Pat. No. 4,437,087, issued on Mar. 13, 1984 to David W. Petr, and commonly assigned to the assignee of the present invention. U.S. Pat. No. 4,437,087 is hereby incorporated by reference as if fully set forth herein.)

In accordance with one such illustrative embodiment of the present invention, the primary coder operates as a normal ADPCM coder. In particular, assume that this primary coder quantizes a particular source sample x to the quantization value $\hat{x}_0$, which can be equivalently modeled as adding a noise component $n_0$ to x—that is, $\hat{x}_0=x+n_0$. (Note that the noise component is equivalent to the resultant quantization error.) Clearly, if the auxiliary coder were to add to the source sample x another noise component $n_1$ that is of the opposite sign to that of $n_0$ (i.e., $\text{sign}(n_1)\neq\text{sign}(n_0)$), the mixed noise at the receiver will be advantageously reduced (when neither bit stream experiences frame erasure or packet loss).

Thus, in accordance with this illustrative embodiment of the present invention, the quantization process of the auxiliary coder is modified so that it encodes to a sub-optimal neighboring reproduction point whenever the (normally) optimal point does not meet the condition that $\text{sign}(n_1)\neq\text{sign}(n_0)$, but the given neighboring point does meet this condition. In other words, the auxiliary coder selects the closest quantization value to the sample point such that the resultant quantization error has an opposite sign to the quantization error which resulted from the coding of the corresponding sample point by the primary coder. In this manner, the overall quantization error of the combined (i.e., mixed) reconstructed signal at the receiver will typically be reduced (as compared to the quantization error which results from a single decoded bit stream), when neither bit stream experiences frame erasure or packet loss.

Illustrative Embodiments of the Present Invention Employing LD-CELP Coders

In accordance with yet other illustrative embodiments of the present invention, a multiple description encoding procedure is provided in which homogeneous coders employing Low-Delay Code Excited Linear Prediction (LD-CELP) coding techniques are employed. (Note that LD-CELP coding techniques are also conventional and are fully familiar to those of ordinary skill in the art. See, e.g., U.S. Pat. No. 5,233,660, issued on Aug. 3, 1993 to Juin-Hwey Chen, and commonly assigned to the assignee of the present invention. U.S. Pat. No. 5,233,660 is hereby incorporated by reference as if fully set forth herein.)

In accordance with one such illustrative embodiment of the present invention, the primary coder operates as a normal LD-CELP coder. (As is fully familiar to those of ordinary skill in the art, the quantization process of an LD-CELP coder typically includes an excitation vector search in which an excitation vector which minimizes an error criterion is selected from a fixed codebook and is then identified by its index therein.) In accordance with the illustrative embodiment of the present invention, the quantization process, and in particular, the excitation vector search module, of the auxiliary coder is modified so that it advantageously selects a different excitation vector (e.g., a vector having a different index in the codebook) than the one which was selected by the primary coder for the corresponding sample point.

In particular, the auxiliary coder performs an excitation vector search to determine the "best match" (i.e., the excitation vector which minimizes the error criterion), as does the primary coder. However, the index of the excitation vector selected by the auxiliary coder is compared to the index of the excitation vector selected by the primary coder, and if these indices are equal, the auxiliary coder uses an alternative choice of an excitation vector—for example, the second "best match" may be advantageously used instead. (Note that if the two coders start out with identical initial conditions, the excitation vector searches will necessarily result in selecting the same excitation vector as the "best match" and thus the two coders will choose the same index. However, once the auxiliary coder has been forced to choose an alternative index, the internal coder states of the primary and auxiliary coders will diverge, and therefore they may subsequently choose different excitation vectors as the best match without any "intervention" at all.) In this manner, and in accordance with the principles of the present invention, the resultant signals are correlated, but the resultant noises (i.e., quantization errors) are not. Therefore, the process of averaging (i.e., mixing) which is performed in the receiver will likely result in a better reconstructed signal, when neither bit stream experiences frame erasure or packet loss.

Illustrative Embodiments which Advantageously Switch Encoder "Roles"

In accordance with certain illustrative embodiments of the present invention, two coders are employed, and the primary versus auxiliary "role" of the two coders is periodically reversed. That is, after a given period of time the above-described functionalities of the primary and auxiliary coders are advantageously reversed. Operationally, with reference to the illustrative two-channel multiple description communications system shown in FIG. 1, diversity control module 13 directs each of the two coders—coder 11 and coder 12—as to when to operate as the primary coder and when to operate as the auxiliary coder. In such a case, both coder 11 and coder 12 may be advantageously identical, whereby each has both the capability to operate in a fully conventional manner (when operating as the primary coder) and the capability to operate in the modified manner (when operating as the auxiliary coder) in accordance with the principles of the present invention and in accordance with the particulars of the specific embodiment thereof.

In accordance with certain illustrative embodiments of the present invention, for example, the "roles" of the coders may be reversed on a regular, periodic basis. In some such illustrative embodiments, the roles may be reversed in such a manner that each of the two coders acts as the primary coder for an equal amount of time. That is, the "roles" of the coders may be switched back and forth at a fixed rate, such as, for example, every 5 milliseconds. In other illustrative embodiments, the roles may be reversed in such a manner that the amount of time that each coder acts as the primary coder is based on various known or estimated characteristics of the corresponding transmission channels. For example, when an estimate of the transmission quality level (i.e., the probability of a packet loss) of each of the two channels is available, it may be desirable to allow the coder associated with the channel of higher quality to act as the primary coder more often than the coder associated with the channel of lower quality. In accordance with one illustrative embodiment of the present invention, for example, the time that each coder acts as the primary coder is directly proportional to the (estimated) quality level of the corresponding channel.

Addendum to the Detailed Description

It should be noted that all of the preceding discussion merely illustrates the general principles of the invention. For example, although the above-described embodiments have been directed to methods and apparatus for performing multi-descriptive source coding of speech signals, it will be obvious to those of ordinary skill in the art that the techniques of the present invention may also be applied to any of a number of other types of source signals which may also be advantageously encoded in a multi-descriptive manner, including, but not limited to, audio signals, video signals, etc. In addition, although the above-described embodiments are shown as providing only two independent channels (with two independent coders and two corresponding encoded bit streams), thereby effectuating a two-channel multi-descriptive coding scenario, it will be obvious to those of ordinary skill in the art that the techniques of the present invention can be easily extended and applied to three or more channels in a completely straightforward manner.

It will also be appreciated that those skilled in the art will be able to devise various other arrangements which, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware, conventional and/or custom, may also be included. Similarly, any switches shown in the Figs. are conceptual only. Their function may be carried out through the operation of program logic, through dedicated logic, through the interaction of program control and dedicated logic, or even manually, the particular technique being selectable by the implementer as more specifically understood from the context.

In the claims hereof any element expressed as a means for performing a specified function is intended to encompass any way of performing that function including, for example, (a) a combination of circuit elements which performs that function or (b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent (within the meaning of that term as used in 35 U.S.C. 112, paragraph 6) to those explicitly shown and described herein.

The invention claimed is:

1. A multi-descriptive encoder for generating a plurality of multi-descriptive bit streams from a single source signal, the encoder comprising:

a source signal input port or supplying the source signal;

a first coder applied to the source signal input port, the first coder for generating a first multi-descriptive bit stream from the source signal, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and a second coder applied to the source signal input port, the second coder for generating a second multi-descriptive bit stream from the source signal, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, wherein said first quantization process and said second quantization process each select said corresponding quantized data values from a single predetermined set of quantization values, and wherein said first and second quantization processes each comprise a pulse code modulation scheme which selects said corresponding quantized data values from a single predetermined set of scalar quantization values, wherein said first data value based on the source signal and said second data value based on the source signal are equal to a common scalar value representative of a portion of said source signal, wherein said first quantized data value is selected from said set of scalar quantization values as an approximation to said common scalar value, and wherein said second quantized data value is selected as a neighboring value in said set of quantization values to said first quantized data value when said common scalar value is closer to an average of said first quantized data value and said neighboring value than to any value in said set of quantization values.

2. The encoder of claim 1 wherein said first coding algorithm and said second coding algorithm differ in at most the corresponding quantization processes included therein.

3. The encoder of claim 1 wherein said source signal comprises a speech signal.

4. The encoder of claim 1 wherein said second quantized data value as produced by said second quantization process is determined so that said second quantization error resulting from said second quantization process is such that if combined with said first quantization error resulting from said first quantization process to produce a net quantization error, said net quantization error will be less than said first quantization error.

5. A multi-descriptive encoder for generating a plurality of multi-descriptive bit streams from a single source signal, the encoder comprising:

a source signal input port for supplying the source signal;

a first coder applied to the source signal input port, the first coder for generating a first multi-descriptive bit stream from the source signal, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and a second coder applied to the source signal input port, the second coder for generating a second multi-descriptive bit stream from the source signal, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, wherein said first quantization process and said second quantization process each select said corresponding quantized data values from a single predetermined set of quantization values, and wherein said first and second quantization processes each comprise a pulse code modulation scheme which selects said corresponding quantized data values from a single predetermined set of scalar quantization values, wherein said first data value based on the source signal is equal to a scalar value representative of a portion of said source signal and said second data value based on the source signal is equal to said first data value offset by a fixed predetermined amount, and wherein said first quantized data value is selected from said set of scalar quantization values as an approximation to said first data value and said second quantized data value is selected from said set of scalar quantization values as an approximation to said second data value.

6. The encoder of claim 5 wherein said first coding algorithm and said second coding algorithm differ in at most the corresponding quantization processes included therein.

7. The encoder of claim 5 wherein said source signal comprises a speech signal.

8. The encoder of claim 5 wherein said second quantized data value as produced by said second quantization process is determined so that said second quantization error resulting from said second quantization process is such that if combined with said first quantization error resulting from said first quantization process to produce a net quantization error, said net quantization error will be less than said first quantization error.

9. A multi-descriptive encoder for generating a plurality of multi-descriptive bit streams from a single source signal, the encoder comprising;

a source signal input port for supplying the source signal;

a first coder applied to the source signal input port, the first coder for generating a first multi-descriptive bit stream from the source signal, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and a second coder applied to the source signal input port, the second coder for generating a second multi-descriptive bit stream from the source signal, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, the encoder further comprising means for modifying said first and second quantization processes in a periodic fashion, such that after a first predetermined amount of time, (i) said first quantization process produces a subsequent first quantized data value based at least in part on a corresponding subsequent second quantization error resulting from said second quantization process, and (ii) said second quantization process produces a subsequent second quantized data value not based on a corresponding subsequent first quantization error resulting from said first quantization process; and after a second predetermined amount of time, (iii) said second quantization process produces a further subsequent second quantized data value based at least in part on a corresponding further subsequent first quantization error resulting from said first quantization process, and (iv) said first quantization process produces a further subsequent first quantized data value not based on a corresponding further subsequent second quantization error resulting from said second quantization process, wherein said first and second predetermined amounts of time are based on quality levels associated with a first communications channel used for transmitting said multi-descriptive bit stream and a second communications channel used for transmitting said second multi-descriptive bit stream, respectively, and wherein a ratio of said first predetermined amount of time divided by said second predetermined amount of time is approximately equal to a ratio of an estimated probability of a frame erasure occurring in a transmission across said second communications channel divided by an estimated probability of a frame erasure occurring in a transmission across said first communications channel.

10. The encoder of claim 9 wherein said first predetermined amount of time and said second predetermined amount of time are equal.

11. A method for performing multi-descriptive encoding of a single source signal and for generating a plurality of multi-descriptive bit streams therefrom, the method comprising the steps of:

coding the source signal with a first coder to generate a first multi-descriptive bit stream, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and coding the source signal with a second coder to generate a second multi-descriptive bit stream, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, wherein said first quantization process and said second quantization process each select said corresponding quantized data values from a single predetermined set of quantization values, wherein said first and second quantization processes each comprise a pulse code modulation scheme which selects said corresponding quantized data values from a single determined set of scalar quantization values, and wherein said first data value based on the source signal and said second data value based on the source signal are equal to a common scalar value representative of a portion of said source signal, wherein said first quantized data value is selected from said set of scalar quantization values as an approximation to said common scalar value, and wherein said second quantized data value is selected as a neighboring value in said set of quantization values to said first quantized data value when said common scalar value is closer to an average of said first quantized data value and said neighboring value than to any value in said set of quantization values.

12. The method of claim 11 wherein said first coding algorithm and said second coding algorithm differ in at most the corresponding quantization processes included therein.

13. The method of claim 11 wherein said source signal comprises a speech signal.

14. The method of claim 11 wherein said second quantized data value as produced by said second quantization process is determined so that said second quantization error resulting from said second quantization process is such that if combined with said first quantization error resulting from said first quantization process to produce a net quantization error, said net quantization error will be less than said first quantization error.

15. A method for performing multi-descriptive encoding of a single source signal and for generating a plurality of multi-descriptive bit streams therefrom, the method comprising the steps of:

coding the source signal with a first coder to generate a first multi-descriptive bit stream, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and coding the source signal with a second coder to generate a second multi-descriptive bit stream, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, wherein said first quantization process and said second quantization process each select said corresponding quantized data values from a single predetermined set of quantization values, wherein said first and second quantization processes each comprise a pulse code modulation scheme which selects said corresponding quantized data values from a single predetermined set of scalar quantization values, and wherein said first and second quantization processes each comprise a pulse code modulation scheme which selects said corresponding quantized data values from a single predetermined set of scalar quantization values, wherein said first data value based on the source signal is equal to a scalar value representative of a portion of said source signal and said second data value based on the source signal is equal to said first data value offset by a fixed predetermined amount, and wherein said first quantized data value is selected from said set of scalar quantization values as an approximation to said first data value and said second quantized data value is selected from said set of scalar quantization values as an approximation to said second data value.

16. The method of claim 15 wherein said first coding algorithm and said second coding algorithm differ in at most the corresponding quantization processes included therein.

17. The method of claim 15 wherein said source signal comprises a speech signal.

18. The method of claim 15 wherein said second quantized data value as produced by said second quantization process is determined so that said second quantization error resulting from said second quantization process is such that if combined with said first quantization error resulting from said first quantization process to produce a net quantization error, said net quantization error will be less than said first quantization error.

19. A method for performing multi-descriptive encoding of a single source signal and for generating a plurality of multi-descriptive bit streams therefrom, the method comprising the steps of:

coding the source signal with a first coder to generate a first multi-descriptive bit stream, the first coder employing a first coding algorithm which includes a first quantization process in which a first data value based on the source signal is coded with use of a corresponding first quantized data value, thereby resulting in a corresponding first quantization error representative of a difference between said first data value and said first quantized data value; and coding the source signal with a second coder to generate a second multi-descriptive bit stream, the second coder employing a second coding algorithm which includes a second quantization process in which a second data value, based on the source signal and corresponding to said first data value, is coded with use of a corresponding second quantized data value, thereby resulting in a corresponding second quantization error representative of a difference between said second data value and said second quantized data value, wherein said second quantized data value as produced by said second quantization process is based at least in part on said first quantization error resulting from said first quantization process, the method further comprising the step of modifying said first and second quantization processes in a periodic fashion, such that after a first predetermined amount of time, (i) said first quantization process produces a subsequent first quantized data value based at least in part on a corresponding subsequent second quantization error resulting from said second quantization process, and (ii) said second quantization process produces a subsequent second quantized data value not based on a corresponding subsequent first quantization error resulting from said first quantization process; and after a second predetermined amount of time, (iii) said second quantization process produces a further subsequent second quantized data value based at least in part on a corresponding further subsequent first quantization error resulting from said first quantization process, and (iv) said first quantization process produces a further subsequent first quantized data value not based on a corresponding further subsequent second quantization error resulting from said second quantization process, wherein said first and second predetermined amounts of time are based on quality levels associated with a first communications channel used for transmitting said first multi-descriptive bit stream and a second communications channel used for transmitting said second multi-descriptive bit stream, respectively, and wherein a ratio of said first predetermined amount of time divided by said second predetermined amount of time is approximately equal to a ratio of an estimated probability of a frame erasure occurring in a transmission across said second communications channel divided by an estimated probability of a frame erasure occurring in a transmission across said first communications channel.

20. The method of claim 19 wherein said first predetermined amount of time and said second predetermined amount of time are equal.

* * * * *